United States Patent [19]

Peraboni

[11] 4,156,490

[45] May 29, 1979

[54] METHOD OF HERMETICALLY SEALING SOFT-DRINK BOTTLES AND LIKE CONTAINERS

[75] Inventor: Antonio Peraboni, Monza, Italy

[73] Assignee: Prot S.r.l., Milan, Italy

[21] Appl. No.: 842,352

[22] Filed: Oct. 14, 1977

Related U.S. Application Data

[63] Continuation-in-part of Ser. No. 722,068, Sep. 9, 1976, abandoned.

[30] Foreign Application Priority Data

May 25, 1976 [IT] Italy ..... 23606/76

[51] Int. Cl.[2] ..... B67B 3/20; B65D 41/34; B65D 41/04; B65D 41/18

[52] U.S. Cl. ..... 215/252; 53/490; 215/354; 264/238; 264/242; 264/274

[58] Field of Search ..... 264/242, 249, 274, 238; 215/252, 258, 317, 318, 340; 53/490, 420

[56] References Cited

U.S. PATENT DOCUMENTS

| | | | |
|---|---|---|---|
| 3,001,657 | 9/1961 | Gamble | 215/252 |
| 3,310,191 | 3/1967 | Kern et al. | 215/252 |
| 3,787,547 | 1/1974 | Stephan | 264/249 |
| 3,907,146 | 9/1975 | Fields | 215/317 |
| 3,910,443 | 10/1975 | Hadley | 215/252 |
| 3,937,348 | 2/1976 | Girala | 215/252 |
| 3,955,696 | 5/1976 | Finke | 215/252 |

FOREIGN PATENT DOCUMENTS

| | | | |
|---|---|---|---|
| 195788 | 2/1958 | Austria. | |
| 712444 | 6/1965 | Canada | 215/258 |
| 362101 | 12/1931 | United Kingdom | 215/258 |

*Primary Examiner*—James B. Lowe
*Attorney, Agent, or Firm*—Karl F. Ross

[57] ABSTRACT

A container such as a soft-drink bottle, provided with a narrower upper neck portion threaded in one direction and a wider lower neck portion threaded in the opposite direction, is hermetically sealed with a cap divided by a frangible zone into top and bottom parts having threads complementary to those of the corresponding neck portions. The cap is placed on the container neck with a rotary screw motion which matingly interfits the upper threads while the lower threads are interengaged with a snap fit as the bottom part of the cap elastically expands.

5 Claims, 6 Drawing Figures

METHOD OF HERMETICALLY SEALING SOFT-DRINK BOTTLES AND LIKE CONTAINERS

CROSS-REFERENCE TO RELATED APPLICATION

This is a continuation-in-part of my copending application Ser. No. 722,068 filed Sept. 9, 1976 and now abandoned.

FIELD OF THE INVENTION

My present invention relates to a method of hermetically sealing soft-drink bottles and like containers by means of a cap screwed onto the container neck, the cap having inversely threaded top and bottom parts of respectively smaller and larger diameter matingly engaging correspondingly threaded upper and lower portions of the neck whereby the bottom part of the cap, acting as a safety ring, is detached along a frangible zone or parting line to rupture the seal upon a first unscrewing of the cap.

BACKGROUND OF THE INVENTION

A closure of this type is known, for example, from U.S. Pat. No. 3,001,657. According to that patent, the cap—initially unthreaded—is slipped around the stepped and threaded bottle neck and is then deformed into mating engagement with the threads. Alternatively, in line with another conventional technique, one part of the cap—generally the upper one—may be prethreaded and screwed onto the corresponding neck portion whereupon the other part is deformed, e.g. by shrinkage, to interfit with its associated neck portion, thereby completing the seal.

OBJECT OF THE INVENTION

The object of my present invention is to provide an efficient one-step method of forming a seal with inversely threaded upper and lower neck portions and cap parts.

SUMMARY OF THE INVENTION

I realize this object, pursuant to my present invention, by prethreading both the top and the bottom part of a cap of elastic material, separated by a frangible zone, and forcing the cap by a rotary screw motion around the container neck with the sense of rotation so chosen that the thread of the top part of the cap matingly interfits that of the upper neck portion while causing elastic expansion of the bottom part of the cap around the inversely threaded larger-diameter lower neck portion until the threads of the latter neck portion and of the bottom part of the cap interengage with a snap fit upon coming into registry with each other. In order to prevent premature interengagement, I prefer to provide the bottom part or safety ring along its lower edge with an inner annular flange designed to underreach a transverse shoulder of the lower neck portion.

Such a cap can be conveniently produced by injection-molding from a suitable plastic material, e.g. polyethylene, having the requisite degree of elasticity. To enhance its radial distensibility, even with less elastic materials, the bottom part or safety ring can be provided with one or more weak spots such as axially extending notches or slots.

A seal so formed can be readily ruptured, even on a bottle whose contents—e.g. a sweetened drink—have a tendency to cause sticking of the cap to the bottle neck.

If desired, the radially expandable safety ring can be removed upon the unscrewing of the top part of the cap serving for reclosure.

BRIEF DESCRIPTION OF THE DRAWING

The above and other features of my invention will now be described in detail with reference to the accompanying drawing in which.

SPECIFIC DESCRIPTION

Figure 1:
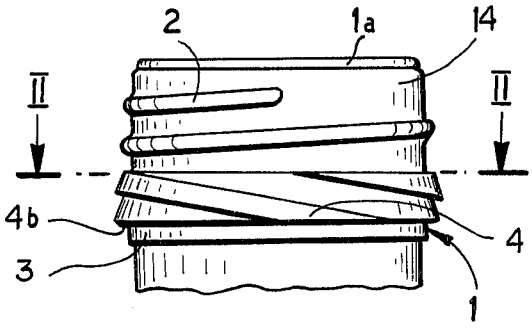
FIG. 1 is a side-elevational view of a bottle neck engageable by a closure cap in conformity with my invention.
Figure 2:
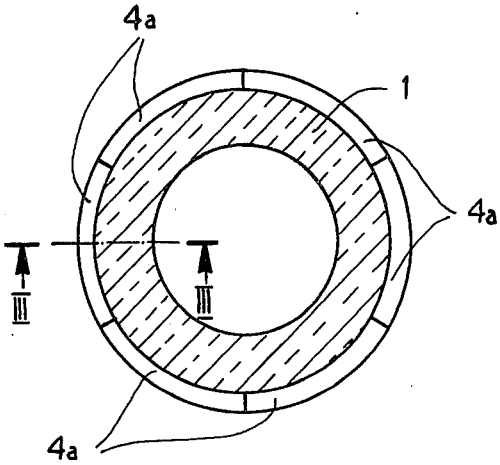
FIG. 2 is a cross-sectional view taken on the line II—II of FIG. 1.
Figure 3:
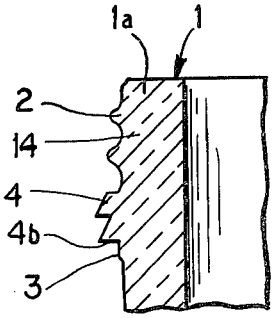
FIG. 3 is a fragmentary axial sectional view taken on the line III—III of FIG. 2.

In FIGS. 1–3 I have shown the neck 1 of a bottle, not further illustrated, with an upper portion 14 and a lower portion 3 of larger diameter than the former. Portions 14 and 3 are formed with coaxial right-handed and left-handed screw threads 2 and 4, respectively, thread 2 being of the single-helix type whereas thread 4 consists of multiple (here six) interleaved helix segments **4*a*. Lower portion 3 is of larger diameter than upper portion 14 so as to protrude radially therebeyond, the radius of the grooves between thread segments 4*a* being about equal to that of the ridges of thread 2. The thread segments 4*a* are cut off at their upper and lower ends by horizontal planes, the lower plane defining a shoulder 4*b*** transverse to the neck axis.

Figure 4:
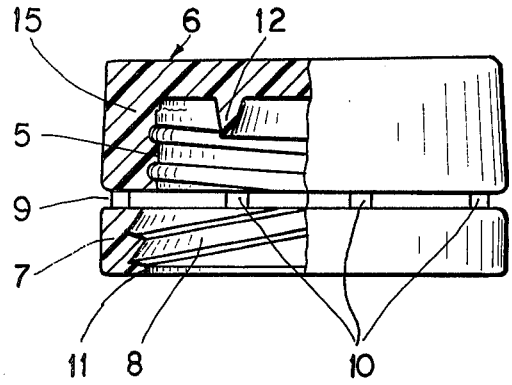
FIG. 4 is an elevational view, partly in section, of a closure cap coacting with the bottle neck of FIGS. 1–3.
Figure 5:
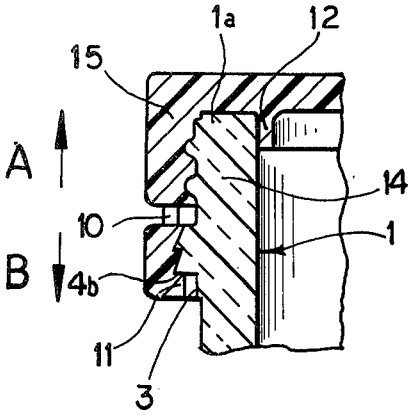
FIG. 5 is a fragmentary sectional view similar to FIG. 2, showing the cap fitted around the bottle neck.
Figure 6:
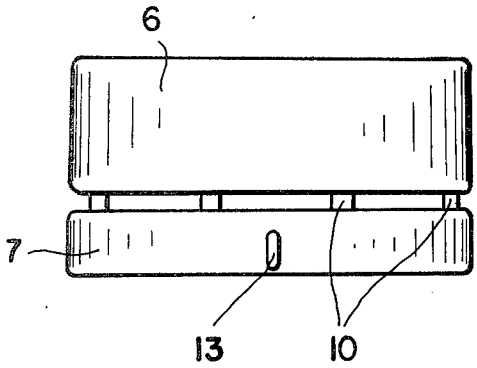
FIG. 6 is an elevational view of the cap, showing same provided with an expansion-facilitating weak spot.

A coacting cap 6 shown in FIGS. 4–6, integrally molded from plastic material, has a top part 15 and a bottom part 7 interconnected by axially extending webs 10 bridging a gap 9 which constitutes a parting line between these parts. Top part 15 has a right-handed screw thread 5, mating with thread 2 of upper neck portion 14, whereas bottom part 7 has a left-handed multiple-segment screw thread 8 complementary to thread 4 of lower neck portion 3. Bottom part, or safety ring, 7 is formed at its lower edge with an inner annular flange 11 whose radius, like that of the ridges of thread 8, equals or slightly exceeds that of the ridges of thread 2 whereby that ring can readily slip over the upper neck portion 14 when the cap 6 and the neck 1 are interfitted to form a hermetic seal on the freshly filled bottle.

An annular boss 12, integrally depending from the horizontal wall of cap 6, extends into the bottle mouth to insure a firm seating of the cap 6 on the free end **1*a* of neck 1 in the closure position shown in FIG. 5. In that same position the flange 11 underreaches the shoulder 4*b* of the lower neck portion 3** with firm all-around interfitting of the neck and the cap.

In order to apply the preformed cap 6 to the bottle neck 1 in the manner illustrated in FIG. 5, the cap is slid down over the end **1*a* of the neck until the flange 11 of ring 7 approaches the lower neck portion 3, at which time the lower end of thread 5 reaches the upper end of thread 2 whereupon clockwise rotation of the cap (as viewed in FIG. 2) interengages the two threads. This rotation, coupled with a downward pressure exerted upon the cap, forces the ring 7 to expand radially around the lower neck portion 3 until the flange 11 clears the shoulder 4***b* even as the top of the cap comes to rest on the end 1*a* of neck 1. A further rotation of up to 60° may then be necessary to align the helix segments of thread 8 with the corresponding grooves of thread 4, and vice versa, resulting in a snap interengagement of the two threads and completion of the seal. An axially extending slot 13, shown in FIG. 6, may be provided in ring 7 to facilitate its radial distension if the cap material is not sufficiently resilient. The sealing operation could be performed by conventional bottling equipment.

In order to break the seal, the user rotates the cap 6 in an unscrewing direction (counterclockwise in FIG. 2) whereby the two mating thread pairs 2,5 and 4,8 drive the top part 15 upwardly (arrow A) and the bottom part 3 downwardly (arrow B) to rupture the webs 10 and allow disengagement of the cap from the bottle neck. Ring 7 can then be easily removed, e.g. by being cut or torn at slot 13. For the unsealing rotation, the user may grip either the top part 15 or the bottom part 7 of cap 6, the latter being more effective if the pitch angle of threads 4, 8 is less than that of threads 2, 4.

I claim:

1. A method of hermetically sealing a container having a neck with an upper portion threaded in one direction and a lower portion of larger diameter than said upper portion threaded in the opposite direction, said lower portion being bounded at its bottom end by a transverse internal annular shoulder, comprising the steps of:

forming a prethreaded cap of elastic material with a top part and a bottom part separated by a frangible zone, said top and bottom parts being provided with threads complementary to those of said upper and lower portions, respectively, said bottom part being further provided with an inner annular flange on a lower edge thereof;

forcing said cap around said neck with a rotary screw motion matingly interfitting the threads of said top part and upper portion while causing elastic radial expansion of said bottom part due to contact with said lower portion for preventing interengagement of the threads of said bottom part and said lower portion until said flange clears said shoulder; and continuing the rotation of said cap until the threads of said bottom part engage the threads of said lower portion with a snap fit.

2. A method as defined in claim 1, comprising the further step of preforming said top part with an inner projection extending into said neck upon the clearing of said shoulder by said flange.

3. A method as defined in claim 1 wherein said cap is formed from plastic material by injection molding.

4. A method as defined in claim 1, comprising the further step of preforming said bottom part with an axially extending weak spot facilitating said radial expansion thereof.

5. A hermetically sealed container made by the method of claim 1.

* * * * *